US005628093A

United States Patent [19]

Goodale

[11] Patent Number: 5,628,093

[45] Date of Patent: May 13, 1997

[54] REVERSIBLE ZIPPER ASSEMBLY

[76] Inventor: Clarke W. Goodale, Rte. 1, Box 158A, Murraysville, W. Va. 26153

[21] Appl. No.: 486,025

[22] Filed: Jun. 7, 1995

[51] Int. Cl.[6] ..... A44B 19/00

[52] U.S. Cl. ..... 24/381; 24/390; 24/400; 24/433

[58] Field of Search ..... 24/381, 390, 399, 24/400, 403, 406, 410, 411, 412, 433

[56] References Cited

U.S. PATENT DOCUMENTS

| | | | |
|---|---|---|---|
| 1,952,506 | 3/1934 | Legat | 24/433 |
| 2,625,726 | 1/1953 | Austin | 24/433 |
| 3,241,161 | 3/1966 | Dashosh . | |
| 3,493,980 | 2/1970 | Haller . | |
| 3,518,991 | 7/1970 | Goss | 24/381 |
| 3,530,487 | 9/1970 | Beer . | |
| 3,534,417 | 10/1970 | Boyles . | |
| 4,224,706 | 9/1980 | Young et al. . | |
| 4,388,738 | 6/1983 | Wagner . | |
| 4,502,155 | 3/1985 | Itoi | 2/94 |
| 4,700,409 | 10/1987 | De Lott | 2/94 |
| 4,757,564 | 7/1988 | Goodale . | |
| 4,809,375 | 3/1989 | Bull . | |
| 4,951,335 | 8/1990 | Eady . | |

FOREIGN PATENT DOCUMENTS

| | | |
|---|---|---|
| 555821 | 2/1960 | Belgium . |

*Primary Examiner*—Victor N. Sakran

[57] ABSTRACT

A mattress assembly includes a mattress base and a mattress top having first and second major surfaces extending to a peripheral edge. Slidable fastener means disposed between the mattress top and the mattress base removably and rotatably attaches the mattress top to the mattress base. In an associated method for moving a body depression in a mattress, the mattress top is attached to the base with at least one zipper having a first side and a second side. Opening the zipper permits removal and rotation of the mattress top relative to the mattress base to move the body depression to a different position. Closing the zipper reattaches the mattress top to the mattress base.

6 Claims, 4 Drawing Sheets

REVERSIBLE ZIPPER ASSEMBLY

BACKGROUND OF THE INVENTION

1. Field of the Invention

This invention relates generally to mattress assemblies and methods for rotating mattresses.

2. Discussion of the Prior

When a person repeatedly lies in the same location on a mattress, a body depression or cavity tends to develop in the materials of the mattress. Such body depressions typically result from a stretching of the mattress fabrics and a compression of the fill material associated with the mattress. Such body depressions are to be avoided since the stretched fabric tends to be unsightly and the compressed fill materials tend to create a relatively hard surface which interferes with sleep. Furthermore, the person sleeping on the mattress tends to lie in a recessed area which may not accommodate a preferred sleeping position providing the best support and comfort.

Body depressions are particularly noticeable when the mattress is shared by a couple. Under these conditions, the amount of area devoted to each individual tends to be reduced, so their sleeping habits are even more restricted to a given area. Furthermore, when two people are sleeping on the same mattress, their differences in weight may be most noticeable in their respective body depressions. Thus in a typical case, the body depression associated with a relatively heavier husband may be particularly severe compared to that of a relatively lighter wife.

In the past, attempts to relieve the stretching and compression associated with body depressions have required that the entire mattress be rotated. Turning the mattress on a vertical axis does not require that the mattress be lifted substantially, but this is still difficult particularly if the bed is located next to a wall. Flipping the mattress about a horizontal axis requires that the mattress be significantly elevated making this a most difficult task.

More recently mattresses of both the water bladder and innerspring coil variations have been constructed with pillow tops which tend to include a thin quilting of cotton or other fibrous materials. These pillow tops have been particularly susceptible to compression so that the body depressions have been even more objectionable in recent years.

Mattress systems such as that disclosed by MAGNUSSON in U.S. Pat. No. 4,449,261 have addressed the removal and rotation of mattress portions but for entirely different reasons. In this case, Magnusson discloses that a pillow top having two major surfaces can be constructed so that each surface presents a different hardness to the person sleeping thereon. Flipping the pillow top enables the person to select the desired degree of firmness. The means for attachment is disclosed to include hook and loop fasteners which facilitate the removal and rotation of the pillow top. Although sliding fasteners such as zippers have been mentioned in this context, there has been no appreciation that a special zipper configuration is required in order to accommodate the removal and rotation of the pillow top.

SUMMARY OF THE INVENTION

In accordance with the present invention, the upper portion of a mattress, which typically forms the body depression, is removable from the mattress base which may have either a water mattress or coil mattress configuration. In at least one embodiment, this upper portion may include, for example, a pillow top. Slidable fastener means, such as zippers, can be used to accommodate both the removal and rotation of the mattress top. Even conventional zippers can be used, although multiple zippers must be provided and they must be assembled with a particular orientation depending on the shape of the mattress. With this construction, the mattress top can be turned on a vertical axis to move the body depression from the person's sleeping area.

The invention also includes a novel zipper construction which accommodates the same removal and rotation of the pillow top using only a single zipper. With the single zipper construction, the mattress top can be flipped about a horizontal axis to move the body depression away from the person's sleeping area.

When multiple zippers of the novel construction are used, the mattress top can be flipped about either of two horizontal axes as well as turned about the vertical axis to offer multiple alternative for rotation of the mattress top.

In one aspect of the invention, a mattress assembly comprises a mattress base and a mattress top, having first and second major surfaces extending to a peripheral edge. Slidable fastener means is disposed between the peripheral edge of the mattress top and the mattress base for removably and rotatably attaching the mattress top to the base. In one embodiment, the slidable fastener means includes a first zipper having a first side and a second side, the first side of the first zipper includes a stop and an ending section, and the second side of the first zipper including a starting lug in each of a beginning section and the ending section.

Thus, in accordance with the present invention, the relatively light pillow top containing the body depression can be detached and rotated with ease. The entire mattress need not be rotated and certainly need not be elevated in the process.

These and other features and advantages of the invention will become more apparent with the description of preferred embodiments and reference to the associated drawings.

DESCRIPTION OF PREFERRED EMBODIMENTS AND BEST MODE OF THE INVENTION

Figure 1:
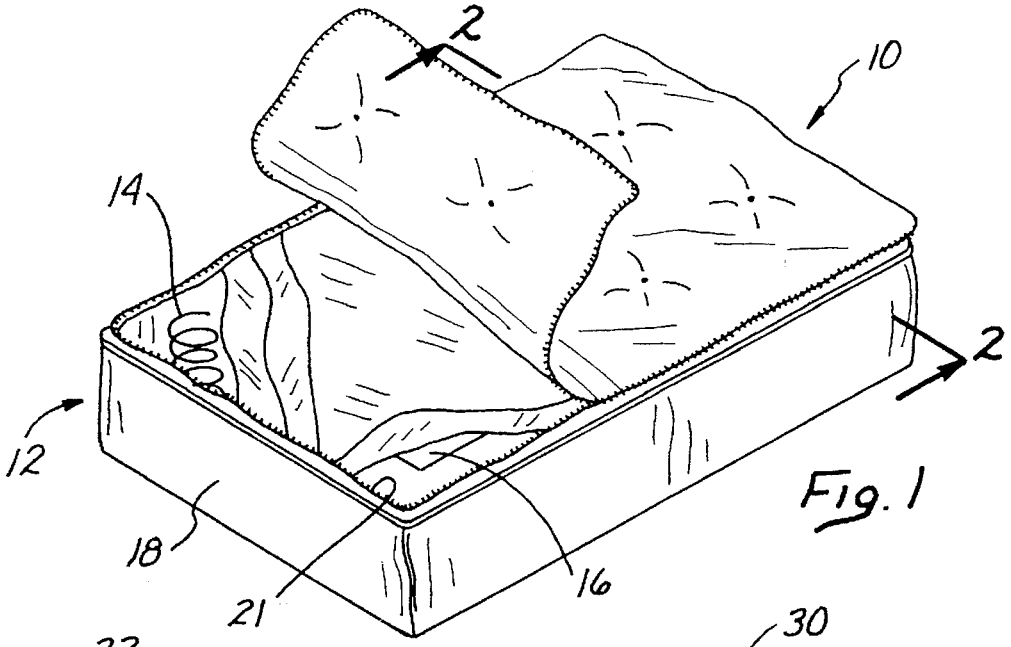
FIG. 1 is a perspective view of a mattress assembly having a pillow/top and a base, which could have either have a coil configuration or a water mattress configuration.

A mattress assembly is illustrated generally in FIG. 1 and designated by the reference numeral 10. This assembly 10 includes a mattress base 12 of a conventional variety which may enclose a plurality of inner spring coils 14 and/or a water mattress bladder 16. In this embodiment, the mattress base 12 includes a surrounding fabric 18 which extends to an upper edge 21.

The mattress assembly 10 also includes a top section 22 which may comprise the single fabric or multiple layers of material. However in a preferred embodiment the top section 22 is provided in the form of a quilted pillow top 23. This pillow top 23 has a peripheral edge 25 which, in a preferred embodiment, is joined to the upper edge 21 of the mattress base 12 by slidable fastener means which may include one or more zippers 27. This junction is perhaps best illustrated in FIG. 2 where the pillow top 23 is further characterized by a quilted configuration.

The top section, such as the pillow top 23, is representative of any portion of the mattress assembly 10 which can be removed from the remainder of the assembly and rotated for reattachment with a different orientation. It will be further appreciated that the invention is applicable to any assembly having two portions joined by slidable fastener means where it is desirable to remove, reorient and reattach one of the portions to the other portion.

Figure 2:
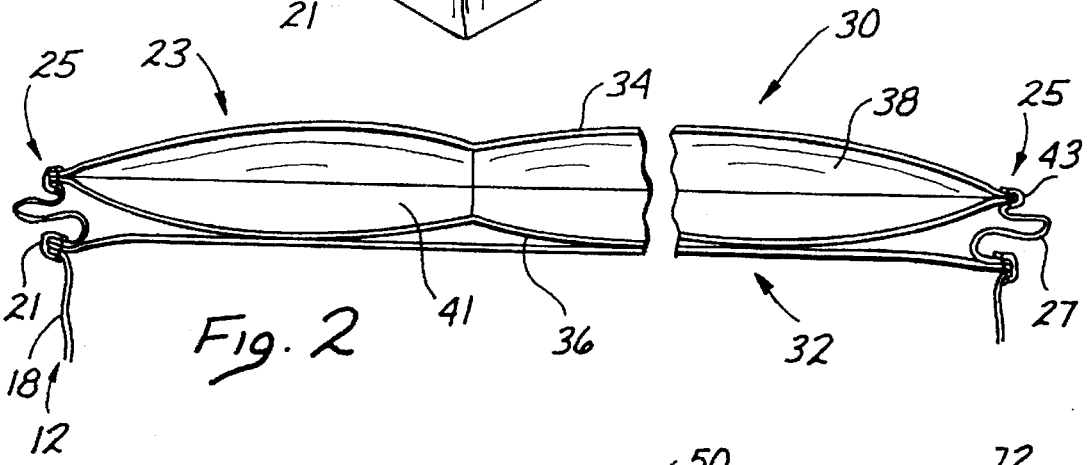
FIG. 2 is a cross-section view of the mattress assembly taken along lines 2—2 of FIG. 1.

As illustrated in FIG. 2, the pillow top 23 has two major surfaces 30, 32 each characterized by an outer fabric 34, 36 respectively. Between these fabrics 34, 36, the pillow top 23 is provided with filler material which may include different materials on opposite sides of the pillow top 23. For example, in the illustrated embodiment, the pillow top 23 is provided with a fibrous wool filler 38 in proximity to the fabric 34, and a continuous fiber open filler 41 in proximity to the fabric 36. This construction can be of particular advantage in a mattress having a reversible pillow top where the wool filler 38 provides a relatively warm sleeping surface during the winter, while the open filler 41 provides a cooler sleeping surface during the summer.

The edges of the fabrics 34 and 36 are sewn with edge tape 43 at a peripheral seam which will typically include one side of the zipper 27. The opposite side of the zipper will typically be joined to the fabric 18 of the mattress base 12 at the upper edge 21. While the zipper 27 can be otherwise disposed between the mattress base 12 and the pillow top 23, its operation is intended to facilitate removal and rotation of the mattress top, such as the pillow top 23, in accordance with the present invention.

Figure 3A:
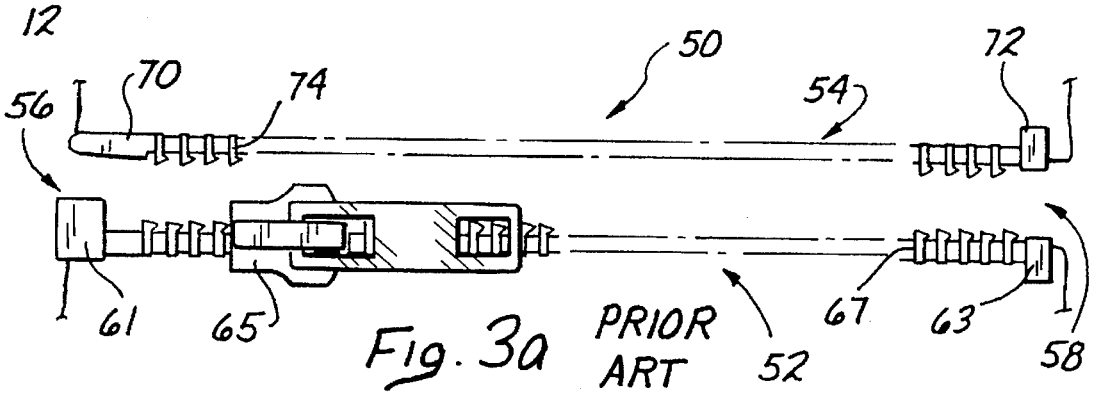
Fig. 3a PRIOR ART
FIG. 3*a* is a top plan view of a conventional zipper construction.

The slidable fastener means, such as the zipper 27, may include a conventional zipper such as that illustrated in FIG. 3*a*. Although this zipper is included in the prior art, its combination with other conventional zippers and the mattress assembly 10 is novel and offers the foregoing advantages of removability and rotatability.

The conventional zipper illustrated in FIG. 3*a* is designated by the reference numeral 50. This zipper 50 includes an operative side 52, a passive side 54, a beginning section 56 and an ending section 58. The operative side 52 includes a base 61 at the beginning section 56 and a stop 63 at the ending section 58. A traveler 65 is movable along a multiplicity of zipper elements 67 which are discretely arranged between the base 61 and the stop 63. The opposing side 54 of the zipper 50 includes a starting lug 70 at the beginning section 56, a stop 72 at the ending section 58 and a multiplicity of zipper elements discretely arranged therebetween.

The operation of this conventional zipper 50 is well known. With the traveler 65 positioned against the base 61, the starting lug 70 is inserted through the traveler into the base 61. As the traveler is advanced from the beginning section 56 to the ending section 58, the zipper elements 67 and 74 interlock to bind the respective sides 52 and 54 of the zipper. It will be noted that in this construction, the stops 63 and 72 are sufficiently large that they will not permit the traveler 65 to pass beyond the end section 58. It will also be noted that the elements 67 and 74 of this conventional zipper are not symmetrical. Rather, the elements 67 point toward the stop 63 while the elements 74 point toward the stop 72.

Figure 3B:
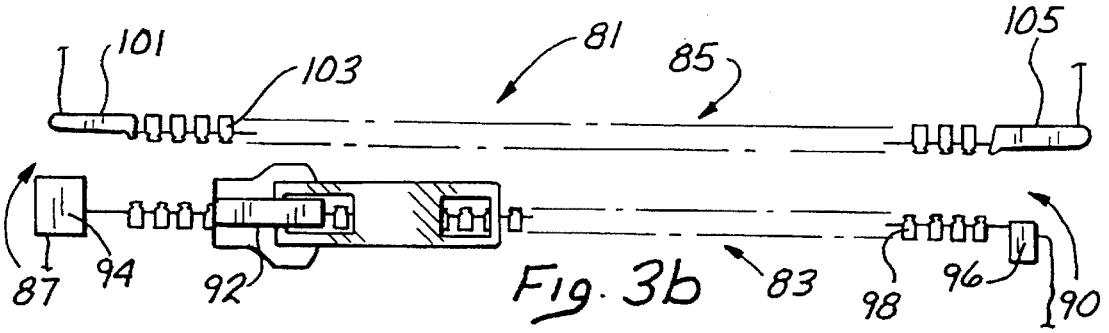
FIG. 3*b* is a top plan view of a novel zipper construction.

A novel zipper configured in accordance with another embodiment of the invention is illustrated in FIG. 3*b*. This zipper, designated by the reference numeral 81, also includes an operative side 83, a passive side 85, a beginning section 87, and an ending section 90. The operative side 83, similarly includes a traveler 92 together with a base 94, a stop 96 and a multiplicity of elements 98 discretely arranged therebetween.

On the opposite side of the zipper 81, a starting lug 101 is disposed at the beginning section 87. A multiplicity of elements 103 are discretely arranged from the starting lug 101 to the ending section 90. Of particular importance to this novel zipper 81 is a starting lug 105 which is disposed in the ending section 90. This starting lug 105 is configured and sized similar to the lug 101 and therefore is not sufficiently large to stop the traveler 92. However, when the traveler joins the elements 98 and 103, it is not permitted to move beyond the ending section 90 due to the presence of the enlarged stop 96 on the operative side 83.

It is also of interest to this novel zipper 81 that the elements 98 and 103 have a symmetrical configuration. Thus each element is configured with a side which faces the ending section 90 and a side which faces the beginning section 87. These sides of the elements 98, 103 are symmetrical in both size and shape in the novel zipper 81.

One important aspect of the present invention can be understood with reference to these two FIGS. 3*a* and 3*b* which illustrate the conventional zipper 50 and the novel zipper 81, respectively. If one were to separate the passive side 54 of the zipper 50 from the operative side 52, and turn this passive side end for end, the stop 72 would be positioned in proximity to the base 61. From this position, any attempt to rejoin the sides 52 and 54 of the zipper 50 would be met with two obstacles. First, the ending lug 72 could not be introduced through the traveler 65 into the base 61. Second, the elements 74 of the passive side 54 would not be facing in the same direction as the elements 67 and therefore could not interlock to close the zipper 50.

Turning now to the novel zipper of FIG. 3*b*, one might again separate the passive side 85 from the operative side 83, and turn it end for end. This would bring the starting lug 105 into proximity with the base 94. This starting lug 105 can be introduced through the traveler 92 and lodged in the base 94 to permit the zipper to be started. Furthermore, the elements 103 are symmetrical so that they easily interlock with the elements 98 as the traveler 92 moves toward the ending section 90. These characteristics of the novel zipper 81 which permit the passive side 85 to be reversed and reattached to the operative side 83, are of particular advantage in the case of the mattress assembly 10.

The remaining FIGS., 4*a*–9*d*, all illustrate in schematic plan view a zipper configuration which may include one or more novel zippers or more than one conventional zipper. These schematic illustrations show two sides of the zippers, an operative side and a passive side. It will be understood that these two sides are of equal length although in FIGS. 4*a*–9*d* the passive sides are shown to be smaller for purposes of illustration. These drawings also show the operative and passive zipper sides attached to the mattress base 12 and pillow top 23, respectively. Of course, these sides could be reversed in other embodiments of the invention. In these figures, the mattress assemblies 10 and associated zippers are also illustrated in a rectangular shape which is typical of a normal mattress configuration. It will be understood that other bed shapes can equally benefit from the concept of the present invention.

Figure 4A:
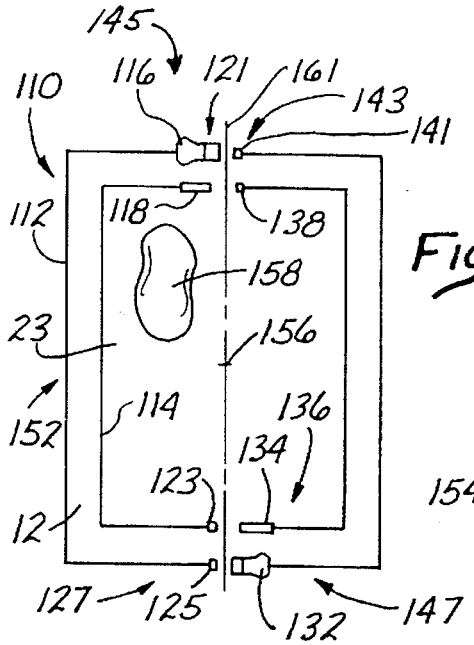
FIG. 4*a* a schematic plan view of one embodiment of a mattress zipper construction of the present invention using conventional zippers to facilitate rotation and reattachment of the pillow top.

Turning now to FIG. 4*a*, it can be seen that the advantages of the present invention which provide for removal and rotation of the pillow top 23 can be accomplished with a conventional zipper construction, but only if that construction includes more than one zipper. In FIG. 4*a*, a conventional zipper 110 includes an operative side 112, which would normally be attached to the base 12 and a passive side 114 which would normally attached to the pillow top 23. The zipper 110 includes a traveler 116 and a starting lug 118 at a beginning section 121, and two stops 123 and 125 at an ending section 127. A second conventional zipper 130 includes a traveler 132 and a starting lug 134 at a beginning section 136 and two stops 138 and 141 at an ending section 143.

This zipper construction is particularly suited for a mattress having a rectangular configuration with two short sides 145, 147 and two long sides 152, 154. Such a mattress is further characterized by a vertical axis 156 which is generally perpendicular to the horizontal plane of the pillow top 23 at the center of the mattress assembly 10.

Figure 4B:
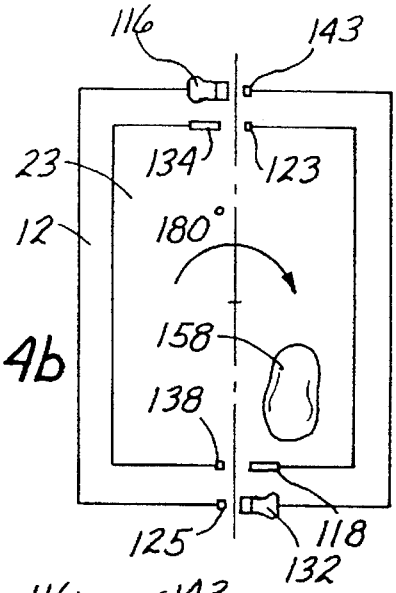
FIG. 4*b* is a schematic plan view illustrating rotation of the pillow top of FIG. 4*a;*

A body depression 158 is illustrated in the outer upper left-hand quadrant of the mattress 10. If it were desired to move this depression 158 to another location on the mattress assembly 10, one would merely open the zippers 110 and 130 to remove the pillow top 23 from the mattress base 12. Then the pillow top 23 could be turned or rotated 180° about the axis 156 as illustrated in FIG. 4*b*. This would bring the starting lug 134 of the zipper 130 into proximity with the traveler 116 of the zipper 110. Similarly, it would bring the starting lug 118 of the zipper 110 into proximity with the traveler 132 of the zipper 130. Importantly, the body depression 158 would move from the outer upper left-hand quadrant to the outer lower right-hand quadrant of the mattress assembly 10. Even if the elements of these zippers were asymmetrical, it would be possible to close the zippers and reattach the pillow top 23 to the mattress base 12.

In this particular embodiment of the invention, a vertical plane 161 passing through the axis 156 separates the mattress 10 into two symmetrical sections each circumscribed by one of the zippers 110 and 130. In the embodiment of FIG. 4*a*, this plane 161 is perpendicular to the short sides 145 and 147. It should be clear however, that the plane 161 could be perpendicular to the long sides 152 and 154 or could be disposed at any other angle as illustrated in the embodiment of FIG. 5*a*.

Figure 5A:
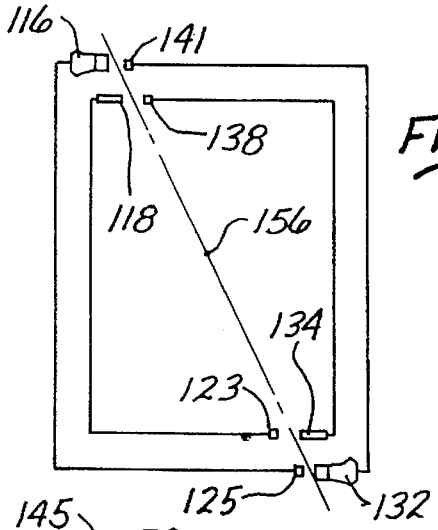
FIG. 5*a* is a schematic plan view of another embodiment of the mattress zipper construction of the present invention.
Figure 5B:
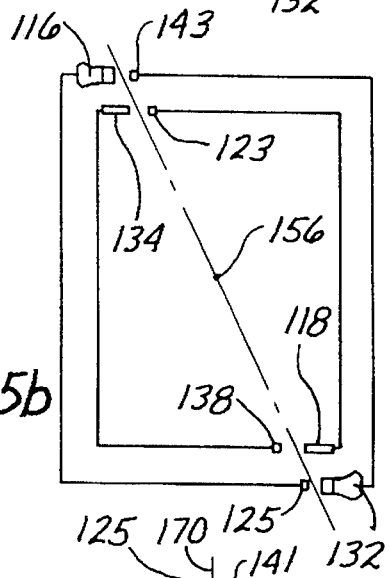
FIG. 5*b* is a schematic plan view illustrating rotation of the pillow top of FIG. 5*a;*

In these embodiments of FIG. 4*a* and 5*a*, the beginning section 121 and ending section 127 of the zipper 110 are disposed in proximity to and on one side of the plane 161. Similarly, the beginning section 136 and ending section 143 of the zipper 130 are disposed in proximity to and on the other side of the plane 161. With the plane 161 dividing the mattress 10 into symmetrical portions, the desired features of removal and rotation can be achieved as illustrated in FIG. 5*b*.

In the FIG. 4*a* embodiment, it will be noted that the starting section 121 of the zipper 110 is disposed along the side 145 of the mattress 10 while the starting section 136 of the zipper 130 is disposed along the opposite side 147 of the mattress 10.

Figure 6A:
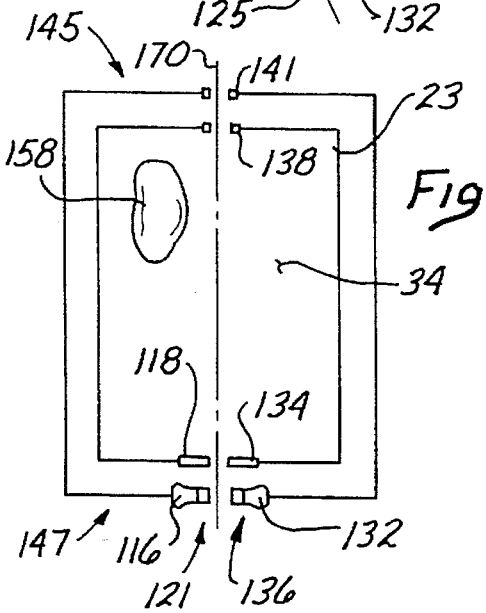
FIG. 6*a* is a schematic plan view of a further embodiment of the mattress assembly using two conventional zippers.
Figure 6B:
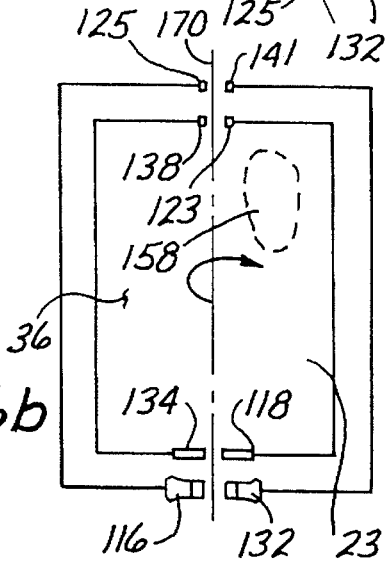
FIG. 6*b* is a schematic plan view illustrating rotation of the pillow top of FIG. 6*a;*

This construction can be compared to that illustrated in FIGS. 6*a* and 6*b* where the starting section 121 of the zipper 110 is disposed along the same side 147 as the starting section 136 of the zipper 130. This mattress is further characterized by a horizontal axis 170 which extends perpendicular to the axis 156 in the plane 161. With the construction of FIG. 6*a*, the pillow top 23 can be rotated about the axis 170 to move the body depression 158 from the outer upper left-hand quadrant to the inner upper right-hand quadrant. It will be noted that in this embodiment, rotation of the pillow top 23 is accomplished not be turning, but rather by flipping the pillow top so that the opposite side of the pillow top 23 is exposed. Thus the outer fabric 34 of the pillow top 23 is exposed in FIG. 6*a* while the outer fabric 36 is exposed in FIG. 6*b*.

The zipper constructions illustrated in FIGS. 4*a*, 5*a*, and 6*a* are all accomplished with conventional zippers of the type described with reference to FIG. 3*a*. It will now be seen that additional features can be achieved using one or more of the novel zippers discussed with reference to FIG. 3*b*.

Figure 7A:
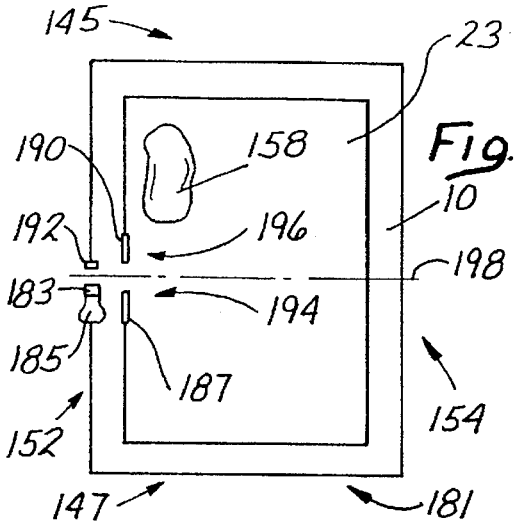
FIG. 7*a* is a schematic plan view of an additional embodiment of the mattress zipper construction using a single novel zipper of the present invention.

In FIG. 7*a*, a single zipper 181 of the novel variety is illustrated to include a base 183, a traveler 185, a starting lug 187, a starting lug 190, and a stop 192. This zipper 181 also has a starting section 194 and an ending section 196 which are preferably disposed on opposite sides of a horizontal axis 198 which bisects the long sides 152 and 154 of the mattress 10. It will be understood that in another embodiment, the axis 198 might bisect the shorter sides 145 and 147.

Figure 7B:
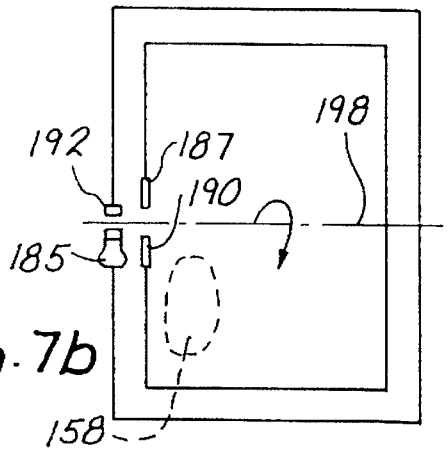
FIG. 7*b* is a schematic plan view illustrating rotation of the pillow top of FIG. 6*a;*

When this zipper construction of FIG. 7*a* is flipped or rotated about the axis 198, the beginning lug 190 is brought into proximity with the traveler 185 thereby permitting the two sides of the zipper 181 to be connected. This rotation of the pillow top 23 moves the body depression from the outer upper left-hand corner to the inner lower left-hand corner as illustrated in FIG. 7*b*. It will be noted that this embodiment of FIG. 7 provides for the removal and rotation of the pillow top 23 using only a single zipper.

Figure 8A:
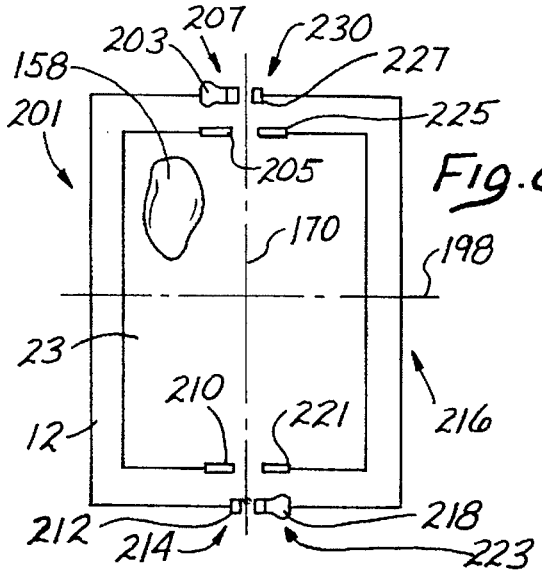
FIG. 8*a* is a schematic plan view of a further embodiment of the mattress zipper construction including two novel zippers of the present invention.

In the following FIGS. 8 and 9, the additional features providing for removal and rotation of the pillow top 23 are accomplished with two of the novel zippers described with reference to FIG. 3*b*. The embodiment of FIG. 8*a* is similar to that of FIG. 4*a* except that the conventional zippers of FIG. 3*a* are replaced with novel zippers of FIG. 3*b*. Thus, the FIG. 8*a* embodiment includes a zipper 201, having a traveler 203 and starting lug 205 at a beginning section 207, and having a starting lug 210 and stop 212 at an ending section 214. An opposing zipper 216 has a traveler 218 and starting lug 221 at a beginning section 223 and a starting lug 225 and stop 227 at an ending section 230. As was the case with the FIG. 4*a* embodiment, the beginning section 207 of the zipper 201 is disposed in proximity to the ending section 230 of the zipper 216. This construction is also characterized by the three axes 156, 170, and 198.

Figure 8B:
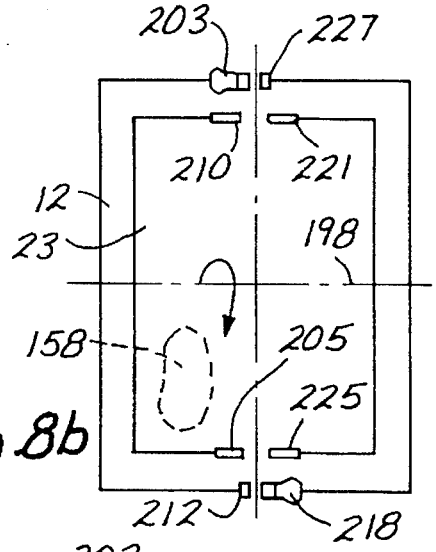
FIG. 8*b* is a schematic plan view illustrating rotation of the pillow top of FIG. 8*a* to a first position of the mattress assembly.

This embodiment of the mattress 10 provides for a pillow top 23 which can be rotated about each of the three axes 156, 170, and 198. As illustrated in FIG. 8*b*, the pillow top 23 can be flipped or rotated about the axis 198 to displace the body depression 158 from the outer upper left-hand quadrant to the inner lower left-hand quadrant. With this rotation, the starting lugs 210 and 225 are positioned for engagement with the respective travelers 203 and 218 to reattach the pillow top 23 to the base 12.

Figure 8C:
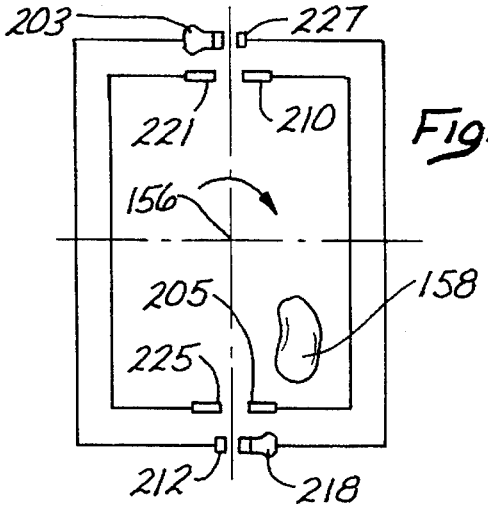
FIG. 8*c* is a schematic plan view illustrating rotation of the pillow top of FIG. 8*a* to a second position of the mattress assembly.

As illustrated in FIG. 8*c*, the pillow top 23 can be turned or rotated about the axis 156 to move the body depression 158 from the outer upper left-hand quadrant to the outer lower right-hand quadrant. This rotation will bring the starting lugs 221 and 205 into proximity with the respective travelers 203 and 218 to permit reattachment of the pillow top 23 to the base 12.

Figure 8D:
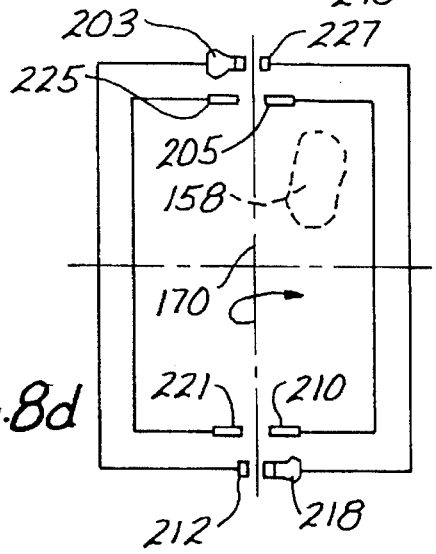
FIG. 8*d* is a schematic plan view illustrating rotation of the pillow top of FIG. 8*a* to a third position of the mattress assembly.

With reference to FIG. 8*d*, it will be apparent that the pillow top 23 of this embodiment can also be flipped or rotated about the axis 170 in order to move the body depression 158 from the outer upper left-hand quadrant to the inner upper right-hand quadrant. This rotation will move the starting lugs 225 and 210 into proximity with the respective travelers 203 and 218 to permit reattachment of the pillow top 23 to the base 12.

A further embodiment of the invention is illustrated in FIG. 9. This embodiment is similar to that illustrated in FIG. 8 except that the whole zipper 201 is reversed so that its beginning section 207 is in proximity to the beginning section 223 of the zipper 216. While the zippers 201 and 216 open and close in the same direction in the FIG. 8*a* embodiment, they open and close in opposite directions in the FIG. 9*a* embodiment.

Figure 9A:
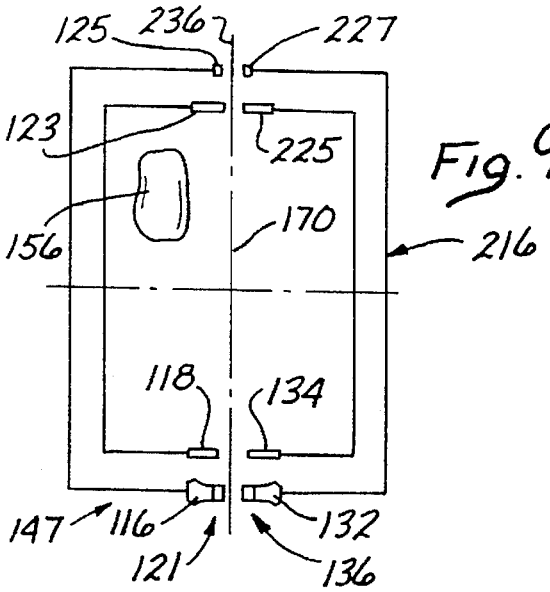
FIG. 9*a* is a schematic plan view of still a further embodiment of the mattress zipper construction using two novel zippers of the present invention.
Figure 9B:
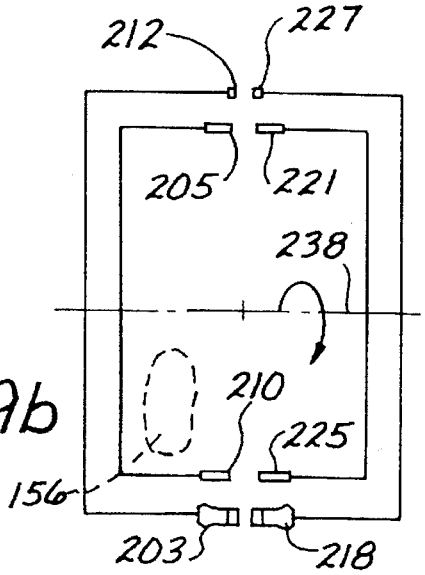
FIG. 9*b* is a schematic plan view illustrating rotation of the pillow top of FIG. 9*a* to a first position of the mattress assembly.

In FIG. 9*b*, the pillow top 23 has been flipped or rotated about the axis 198 to bring the starting lugs 210 and 225 into proximity with the respective travelers 203 and 218. In this position, the pillow top 23 can be reattached to the base 12. Thus with this embodiment, the pillow top 23 can be removed, rotated, and reattached to move the body depression 158 from the outer upper left-hand quadrant to the inner lower left-hand quadrant.

Figure 9C:
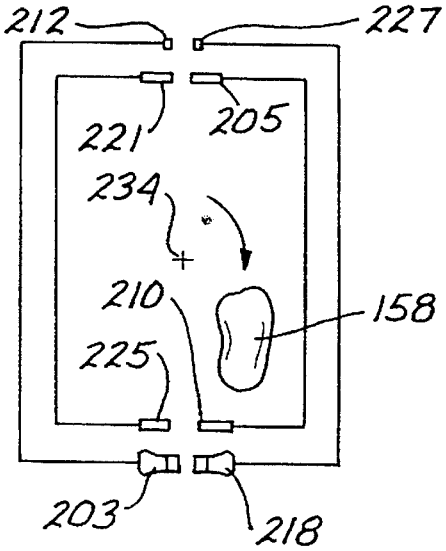
FIG. 9*c* is a schematic plan view illustrating rotation of the pillow top of FIG. 9*a* to a second position of the mattress assembly.

In FIG. 9*c*, the pillow top 23 has been turned or rotated about the vertical axis 156 to bring the starting lugs 225 and 210 into proximity with the respective travelers 203 and 218. In this position, the pillow top 23 can be reattached to the base 12. Thus with this embodiment, the pillow top 23 can be removed, rotated and reattached to move the body depression 158 from the outer upper left-hand quadrant to the outer lower right-hand quadrant.

Figure 9D:
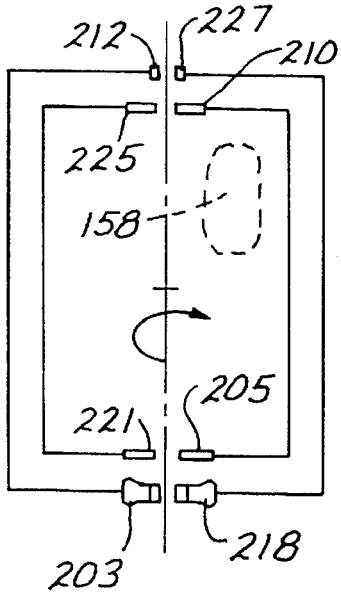
FIG. 9*d* is a schematic plan view showing rotation of the pillow top of FIG. 9*a* to a third position of the mattress assembly.

Finally, FIG. 9*d* illustrates the pillow top 23 flipped or rotated about the axis 170 to bring the starting lugs 221 and 205 into proximity with the respective travelers 203 and 218. In this position, the pillow top 23 can be reattached to the mattress base 12. Thus with this embodiment, the pillow top 23 can be removed, rotated and reattached to move the body depression 158 from the outer upper left-hand quadrant to the inner upper right-hand quadrant.

From the foregoing description, it will be apparent that this invention includes many apparatus and methods for moving a body depression into the four different quadrants of a mattress without lifting the entire mattress assembly. In some cases, more than one conventional zipper can be used to accomplished this result. However, in a preferred embodiment, a novel zipper construction facilitates this operation and maximizes the alternatives for movement.

Although this novel zipper construction has been disclosed with reference to a mattress, it will be apparent that its features permitting removal, rotation and reattachment will be of interest in many other places where zippers are commonly used. It will now be apparent, for example, that a coat lining could be attached to a coat with this zipper construction. Such a lining might be composed of a fabric having one pattern on one side of the lining and a different pattern on the other side of the lining. Then the lining could be removed, rotated and reattached to display the lining of choice.

Given these wide variations, which are all within the scope of this concept, one is cautioned not to restrict the invention to the embodiments which have been specifically disclosed and illustrated, but rather encouraged to determine the scope of the invention only with reference to the following claims.

I claim:

1. An elongate zipper extending between a first end and a second end, comprising:

a first side of the zipper extending between the first end and a second and having a multiplicity of discrete first elements;

a second side of the zipper extending between the first end and the second end and having a multiplicity of discrete second elements interlockable with the first elements of the first side to removably attach the first side of the zipper to the second side of the zipper;

a stop included in the first side of the zipper at the second end of the zipper;

a starting lug included in the second side of the zipper at each of the first end and the second end of the zipper; and wherein the second side is attached by an edge without elements to a closure edge of a reversible material and the first side is attached by an edge without elements to a closure edge of other materials, whereby the reversible material is adapted to be reversed with respect to the other materials such that the second end of the second side is in engaging relationship with the first end of the first side.

2. The zipper recited in claim 1 wherein the first elements and second elements are symmetrical so that the second side of the zipper can be reversed end for end and reattached to the first side of the zipper.

3. The zipper recited in claim 2 wherein at least one of the second elements includes a first side which faces the first end of the zipper and a second side which faces the second end of the zipper, the first side and the second side of the at least one of the second elements being similar in size and shape.

4. The zipper recited in claim 1 further comprising a beginning section disposed at the first end on the first side of the zipper; and a traveler moveable between the beginning section and the stop on the first side of the zipper.

5. The zipper recited in claim 1 further comprising two of the elongate zippers with bi-directionally interlocking elements and whose second sides are arranged at closure edges of a piece of reversible material and whose first sides are arranged at closure edges of one or more other pieces of material.

6. The zipper recited in claim 5 further comprising adapting the two elongate zippers such that reversing the reversible material with respect to the other pieces of material places in engagable relationship a second starting end of a first elongate zipper with a first end of a second elongate zipper and a second starting end of a second elongate zipper with a first end of a first elongate zipper.

* * * * *